US009339942B2

(12) United States Patent
Steingrueber et al.

(10) Patent No.: US 9,339,942 B2
(45) Date of Patent: May 17, 2016

(54) FOIL CUTTING TOOLS FOR SHEET METAL PROCESSING MACHINES AND RELATED SYSTEMS AND METHODS

(75) Inventors: Oliver Steingrueber, Stuttgart (DE); Holger Skare, Eberdingen-Hochdorf (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 199 days.

(21) Appl. No.: 13/424,695

(22) Filed: Mar. 20, 2012

(65) Prior Publication Data

US 2012/0260780 A1 Oct. 18, 2012

(30) Foreign Application Priority Data

Mar. 21, 2011 (EP) ..... 11159046

(51) Int. Cl.

| | |
|---|---|
| ***B26D 5/08*** | (2006.01) |
| ***B26F 3/04*** | (2006.01) |
| ***B26D 3/08*** | (2006.01) |
| ***C23F 1/08*** | (2006.01) |
| *B26F 1/38* | (2006.01) |

(52) U.S. Cl.

CPC . *B26F 3/04* (2013.01); *B26D 3/085* (2013.01); *C23F 1/08* (2013.01); *B26F 1/3813* (2013.01); *Y10T 83/04* (2015.04); *Y10T 83/263* (2015.04); *Y10T 83/6656* (2015.04); *Y10T 83/9372* (2015.04)

(58) Field of Classification Search

CPC ..... B21D 5/08; B30B 1/18; Y10T 83/9372; Y10T 83/04; Y10T 83/6656; Y10T 83/263; B26F 1/3813; B26F 3/04; B26F 3/085; C23F 1/08

USPC ..... 83/623, 561, 575, 532, 667, 681, 691

See application file for complete search history.

(56) References Cited

U.S. PATENT DOCUMENTS

| | | | | |
|---|---|---|---|---|
| 3,463,042 | A * | 8/1969 | Goldman | 83/627 |
| 3,787,968 | A * | 1/1974 | Littmann | 30/124 |
| 3,830,128 | A | 8/1974 | Cochran et al. | |
| 4,674,372 | A * | 6/1987 | Mobley | 83/30 |
| 5,207,141 | A * | 5/1993 | Dehari | 83/471.3 |
| 5,211,687 | A * | 5/1993 | Loser | 144/361 |
| 6,577,804 | B2 * | 6/2003 | Murakami et al. | 385/147 |
| 8,505,207 | B2 * | 8/2013 | Thien | 30/276 |
| 2002/0069736 | A1 | 6/2002 | Yasoda et al. | |
| 2004/0216580 | A1 * | 11/2004 | Taillon | 83/835 |
| 2005/0056127 | A1 * | 3/2005 | Yamabuchi et al. | 83/13 |
| 2009/0000441 | A1 * | 1/2009 | Hasebe et al. | 83/53 |
| 2010/0005941 | A1 * | 1/2010 | Schueppstuhl | 83/879 |
| 2012/0037605 | A1 * | 2/2012 | Schmidt et al. | 219/121.72 |
| 2012/0152078 | A1 * | 6/2012 | Benard et al. | 83/434 |
| 2012/0325070 | A1 * | 12/2012 | Bando | 83/880 |
| 2013/0233135 | A1 * | 9/2013 | MacFarlane | 83/13 |

FOREIGN PATENT DOCUMENTS

| | | |
|---|---|---|
| CN | 1338439 | 3/2002 |
| CN | 1267255 C | 8/2006 |

(Continued)

*Primary Examiner* — Omar Flores Sanchez

(74) *Attorney, Agent, or Firm* — Fish & Richardson P.C.

(57) ABSTRACT

In some aspects, a tool for a sheet metal processing machine for penetrating a foil disposed on a surface of workpiece to be processed includes a rotatably supported ball for cutting the foil by rolling the ball along the workpiece.

18 Claims, 4 Drawing Sheets

(56) References Cited

FOREIGN PATENT DOCUMENTS

| | | | |
|---|---|---|---|
| CN | 101657388 | A | 2/2010 |
| CN | 101733768 | A | 6/2010 |
| EP | 1747859 | A1 | 1/2007 |
| EP | 2147900 | A1 | 1/2010 |
| EP | 2189259 | A1 | 5/2010 |
| JP | 08090989 | A | 4/1995 |
| JP | 08300292 | A | 11/1996 |
| JP | 02-085600 | U | 3/2002 |
| JP | 10-087158 | A | 4/2010 |
| JP | 2011020224 | A | 2/2011 |
| WO | WO2010015357 | A1 | 2/2010 |

* cited by examiner

FOIL CUTTING TOOLS FOR SHEET METAL PROCESSING MACHINES AND RELATED SYSTEMS AND METHODS

CROSS-REFERENCE TO RELATED APPLICATION

This application claims priority under 35 U.S.C. §119 to European Patent Application No. EP 11 159 046.9, filed on Mar. 21, 2011. The contents of this priority application are hereby incorporated by reference in their entirety.

TECHNICAL FIELD

This disclosure relates to foil cutting tools for sheet metal processing machines and to related systems and methods.

BACKGROUND

Tools for cutting the protection foil on sheet metal workpieces typically have a scriber. The scriber generally has a tip angle of 90° and is spring loaded in order to cut through the foil but not damage the surface of the sheet metal workpiece on which the foil is laid. The necessary press force to cut the foil may be varied by using pressure springs with different pressing forces. However, the resistance against the tool can increase when slight unevenness of the surface structure or differences of thickness of the sheet metal workpiece are present. As a result, scratches or imprints on the sheet metal workpiece can easily occur, in particular, when a direction of processing (e.g., the direction of the scriber motion) is oblique to a direction of grinding of a brushed sheet metal workpiece. Tools having a spring biased cutting wheel that rolls along the surface of the sheet metal workpiece and cuts the foil are also known.

SUMMARY

In an aspect, a tool for a sheet metal processing machine for cutting a foil disposed on a surface of workpiece to be processed includes a rotatably supported ball for cutting the foil by rolling the ball along the workpiece.

In another aspect, a system includes a sheet metal processing machine and a tool for cutting a foil disposed on a workpiece to be processed by the sheet metal processing machine. The tool includes a rotatably supported ball for cutting the foil by rolling the ball along the workpiece. The sheet metal processing machine includes a tool holder for accommodating the tool and a workpiece support device for positioning the workpiece, and the sheet metal processing machine is configured such that the tool holder or the workpiece support device is vertically movable such that a determinable distance between the tool holder and a surface of the workpiece is produced so that the ball penetrates the foil and the determinable distance can be maintained while the sheet metal is moved horizontally with respect to the tool holder in order to cut the foil.

In another aspect, a method for penetrating a foil applied on a surface of a sheet metal workpiece includes moving a tool holder towards the workpiece or moving the workpiece towards the tool holder so that the tool holder and the surface of the workpiece are separated by a predetermined distance at which the ball penetrates the foil, and moving the holder or the workpiece relative to one another, wherein the predetermined distance is maintained so that the ball penetrates the foil by rolling along the surface of the workpiece.

In some aspects, the tool includes a rotatably supported ball that can be used to cut the foil by a rolling cutting movement. As a result, obstacles (e.g., unevenness or variations in workpiece thickness) can be rolled over without creating significant damage (e.g., scratches or imprints). Due to the rolling movement, little (e.g., no) sliding movement between the cutting tool (i.e., the rotatably supported ball of the cutting tool) and the surface of the workpiece occurs so that the abrasion of the ball is limited. Furthermore, it is possible to cut the foil along arbitrary paths with, in some cases, small radii. Moreover, it is possible to apply greater pressure forces to the tool because, due to the rolling movement, the surface of the workpiece is typically treated more gently than when a sliding movement occurs (i.e., as opposed to scraping with a blade device). Thus, uneven foils may be cut in a process that is more reliable than some other cutting methods.

The tools described herein can be used to prepare an area of a workpiece for processing with reduced likelihood of damaging the surface of the workpiece and also to create various contours in the foil. For example, the tools can be used to cut curves and contours having smaller radii than some other foil cutting tools.

The details of one or more embodiments of the systems and methods are set forth in the accompanying drawings and the description below. Other aspects, features, and advantages of the systems and methods will be apparent from the description and drawings, and from the claims.

DETAILED DESCRIPTION

Figure 1:
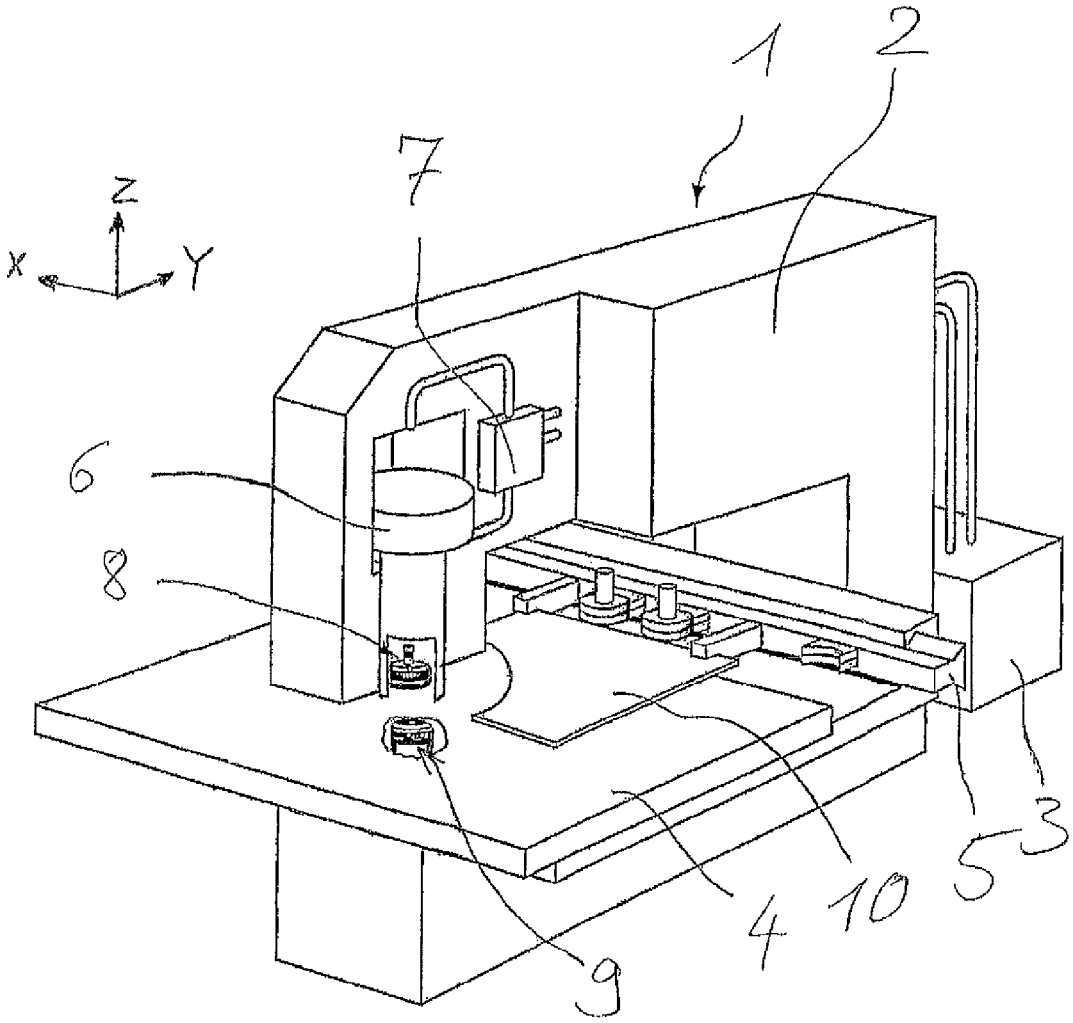
FIG. 1 shows a sheet metal processing machine (e.g., a sheet metal punching machine).

FIG. 1 shows a sheet metal processing machine (e.g., punching machine) 1. Other processing machines, for example, laser processing machines, such as laser cutting machines, laser welding machines, or combined punching/laser cutting machines, are also possible.

The punching machine 1 includes a C-frame 2 as a structural support member. The C-frame 2 is typically made of a torsion-stiff welding construction made of steel. A hydraulic power unit 3 is arranged at a rear end of the C-frame 2 to serve as a power source for the punching movements produced by the punching machine 1.

The punching machine 1 also includes a machine control unit connected to the actuators of the punching machine 1 for controlling the actuators.

At a lower inner side of the C frame 2, a workpiece support device 4 in the form of a machine table for placement of a workpiece (e.g., a plate-like sheet metal workpiece) 10 is provided.

Along the workpiece support device 4, a workpiece movement device 5 is arranged that includes a guide and a cross rail with clamping claws for gripping and moving the workpiece 10 on the workpiece support device 4.

At a front end of the upper branch of the C-frame 2, a plunger 6 with a plunger controller 7 is provided. The plunger 6 is controllable by the plunger controller 7 such that it can be stopped in any arbitrary position along the range of its stroke in a Z-direction. Thus, the plunger 6 can be moved to a determinable distance relative to the workpiece 10 lying on the workpiece support device 4 and the determinable distance can be maintained during a movement of the workpiece 10 by the workpiece movement device 5.

In the plunger 6, an upper tool holder 8 is provided for accommodating an upper part of a punching tool or other types of tools (e.g., stamp and die tools or foil cutting tools, as discussed herein).

At the front end of the lower branch of the C-frame 2, a lower tool holder 9 is provided for accommodating a lower part of a punching tool or other types of tools (e.g., stamp and die tools or foil cutting tools, as discussed herein).

During use, the workpiece 10 is positioned for a machining operation by displacing the gripped workpiece 10 in an X-direction and a Y-direction by the workpiece movement device 5. As a result, the workpiece 10 slides in the X-direction on the machine table and is moved together with the machine table in the Y-direction. The machining operation (e.g., a punching operation) is initiated after positioning the workpiece 10 so that the area of the workpiece 10 to be worked is located at a defined position in the range of the punching tool. The plunger 6 moves downwards about a predetermined distance and punches an orifice into the workpiece 10. Then, the plunger 6 moves upwards to an upper position and the workpiece 10 is repositioned for the next machining operation.

Figure 2:
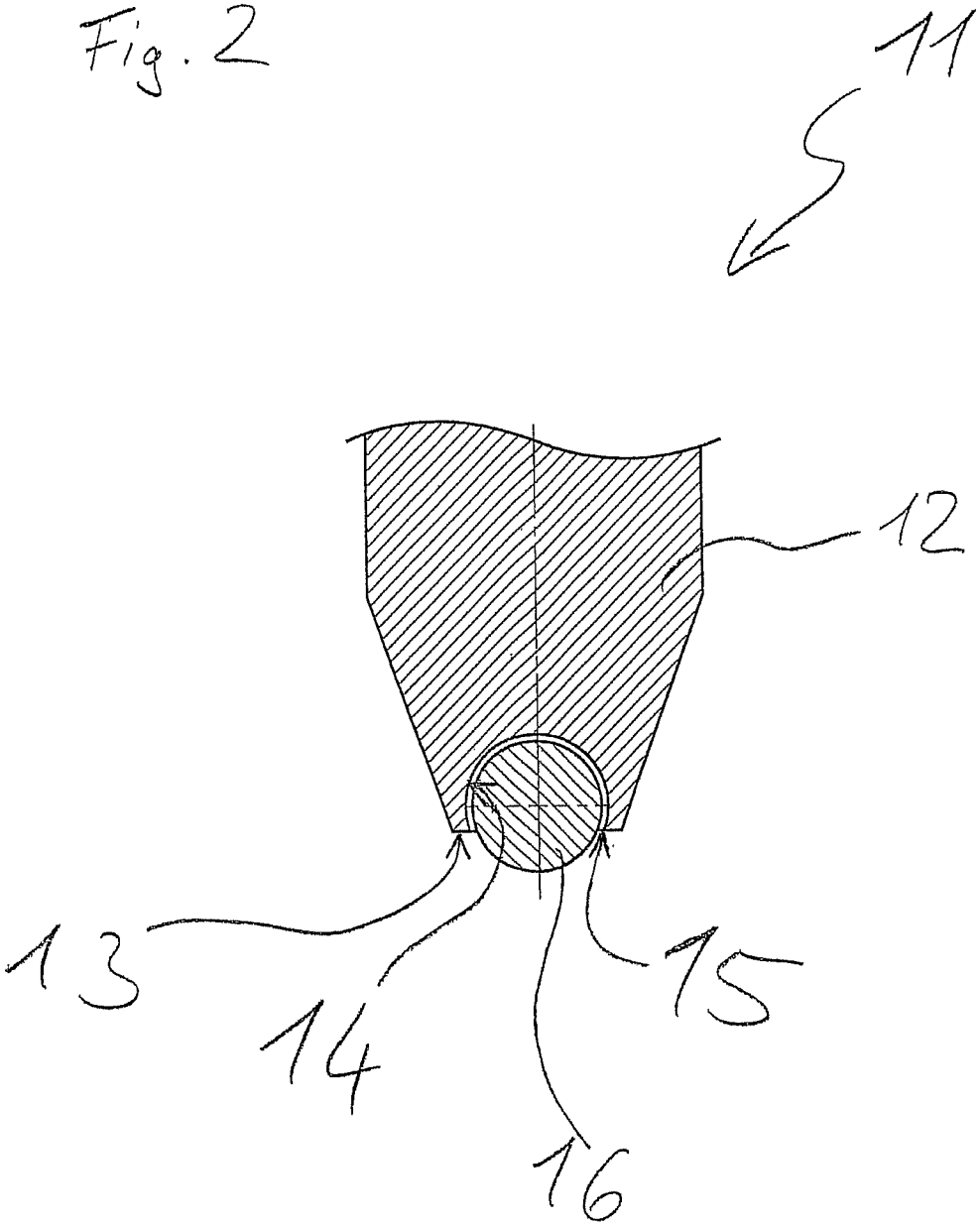
FIG. 2 shows an enlarged cross-section of a schematic illustration of a lower portion of an exemplary cutting tool.

FIG. 2 is a schematic illustration of a lower portion of a tool 11 for cutting protection foil disposed on the workpiece 10. The tool 11 includes a ball accommodation apparatus 12 having a cylindrical portion and a truncated conical portion. The truncated conical portion includes an accommodation chamber 14 at an end 13 facing the workpiece 10 (shown in FIG. 3). The accommodation chamber 14 includes an orifice 15 at the end 13.

In particular, the accommodation chamber 14 is formed to be partially spherical. A ball 16 is disposed and retained in the accommodation chamber 14. The accommodation chamber 14 is formed with respect to the ball 16 such that the ball 16 is supported rotatably but is not displaceable within the accommodation chamber 14. The ball 16 protrudes out of the ball accommodation apparatus 12 through the orifice 15.

The ball 16 is made of a material that is harder than the material of the workpiece 10 in order to limit wear (e.g., a flattening of the ball 16) if the ball 16 slides along the workpiece 10 without rolling. Such wear can lead to additional problems during the subsequent rolling of the ball 16. The material and the surface of the ball 16 are selected such that a small coefficient of friction exists between the material and the surface of the ball 16 and the material and the surface of the ball accommodation apparatus 12. In some embodiments, the ball 16 is made of ceramic. However, it can also be made of other suitable materials. Typically, the ball 16 for cutting foils has a diameter that is smaller than about 1 mm. A diameter of about 0.5 mm or smaller is suitable.

Figure 3:
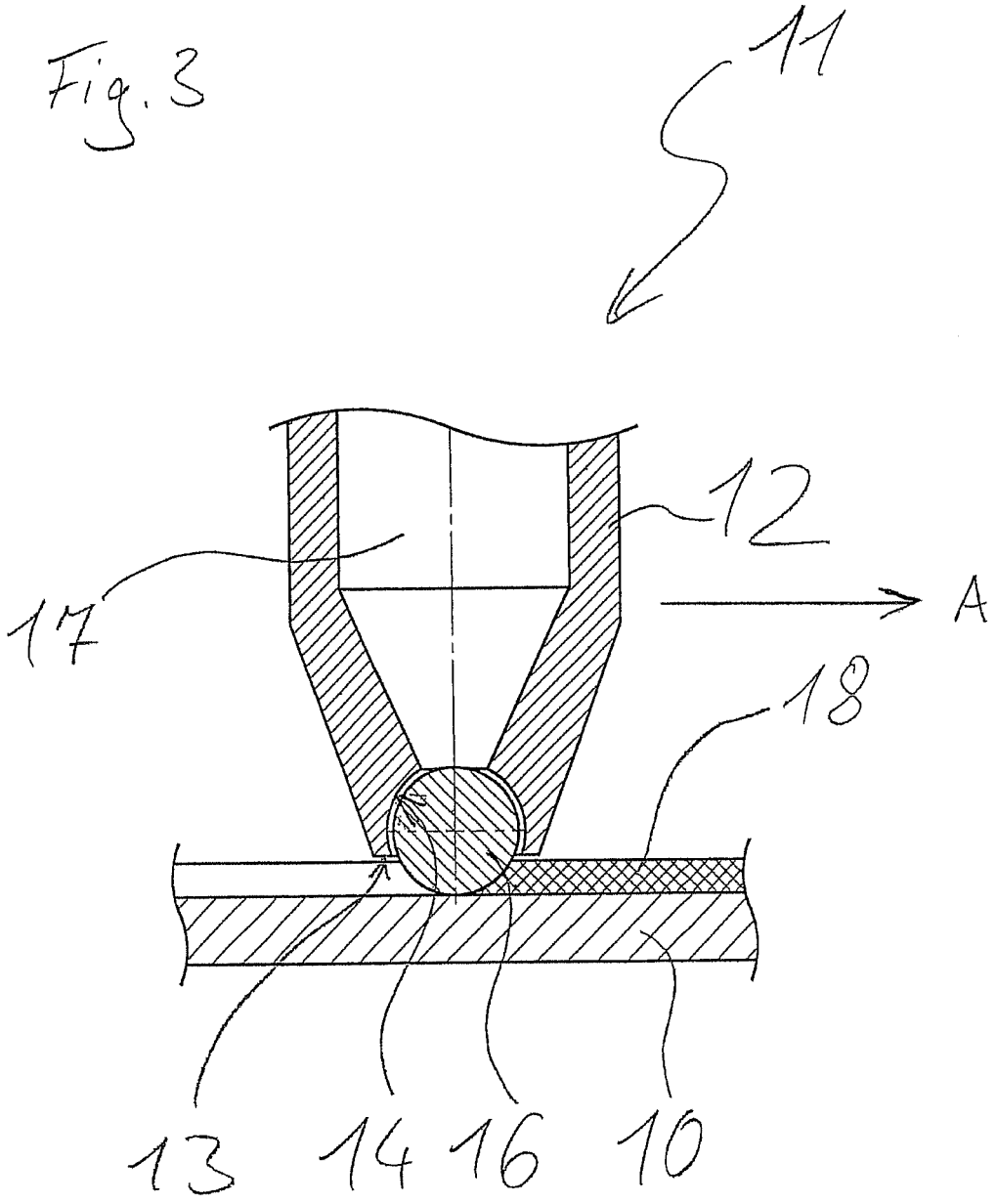
FIG. 3 shows an enlarged cross-section of a schematic illustration of a lower portion or another exemplary cutting tool cutting a foil.

FIG. 3 shows a schematic illustration of a lower portion of another example of the tool 11 during the cutting of a foil 18. The foil 18 is adhesively attached on the workpiece 10 in order to protect the workpiece 10 from scratches. The workpiece 10 may be substantially flat or it may have other shapes (e.g., a curved shape).

The tool 11 includes a cavity 17 for accommodating a fluid. The cavity 17 is fluidly connected to the accommodation chamber 14 for delivering a fluid from the cavity into the accommodation chamber 14. In some embodiments, the fluid is a lubricant for reducing the coefficient of friction between a surface of the ball 16 and the inner surface of the accommodation chamber 14. Therefore, the rolling of the ball 16 along the workpiece 10 can be improved. The accommodation apparatus 12 is arranged so that the end 13 of the ball accommodation apparatus 12 faces the workpiece 10.

As shown in FIG. 3, the ball 16 completely penetrates the foil 18 so that the ball 16 contacts the surface of the workpiece 10. The tool 11 is moved in a direction A. In the movement direction A, in front of the ball 16, the foil 18 is shown intact before cutting, whereas, behind the ball 15 (relative to the movement direction A), the foil 18 is cut and removed.

Figure 4:
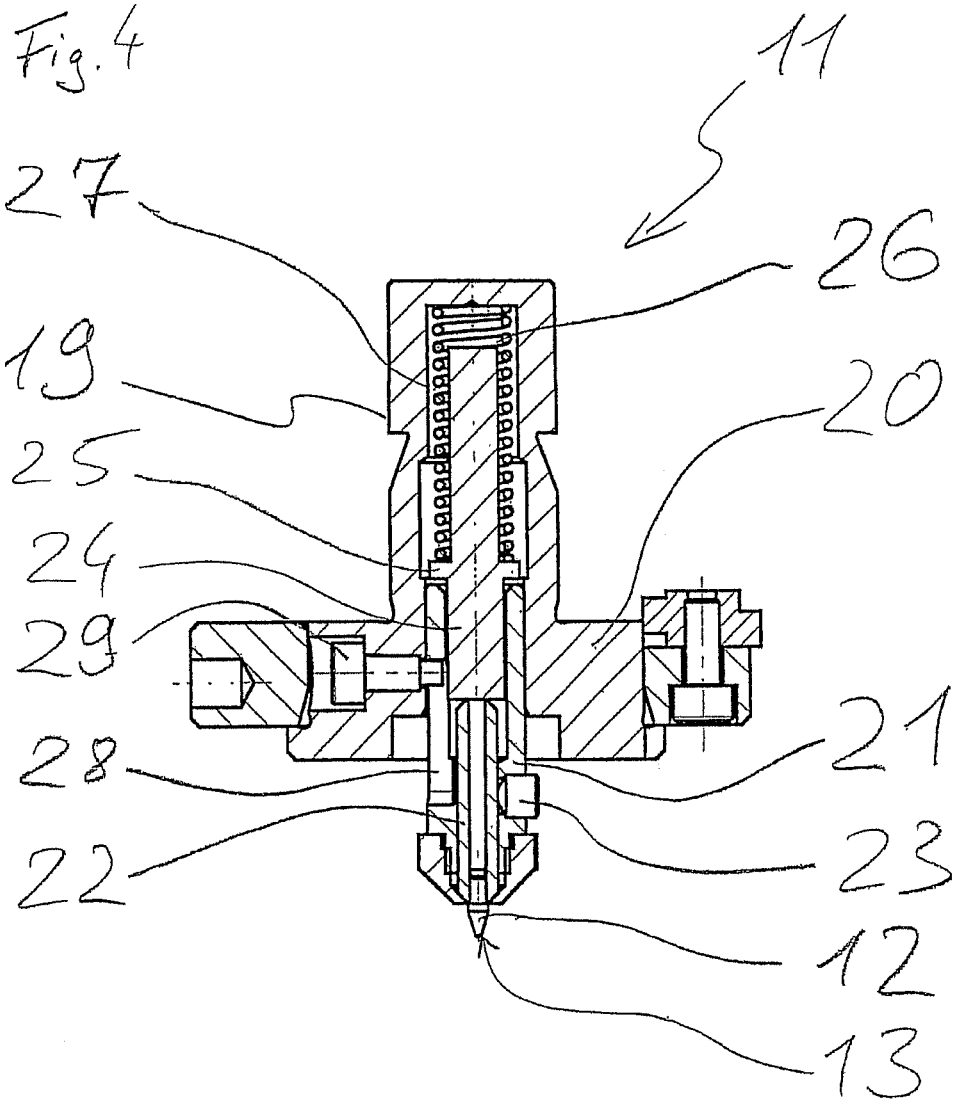
FIG. 4 shows a cross-section of a tool that can be accommodated in a tool holder of the processing machine of FIG. 1.

As shown in FIG. 4, the tool 11 is receivable in the upper tool holder 8 of the punching machine 1 (shown in FIG. 1). The tool 11 includes a stamp shaft 19 formed substantially cylindrically with a truncated plunge conical recess near its upper end so that it is accommodated in the tool holder 8 in a form fit manner with reduced likelihood of backlash. In FIG. 4, the tool 11 is illustrated in an installation position in the upper tool holder 8, however, the tool holder 8 itself is not shown.

The tool 11 also includes a lower portion 20. A blind hole 27 extends through the lower portion 20 and from the lower portion 20 through the stamp shaft 19.

As shown in FIG. 4, the ball accommodation apparatus 12 is provided at the lower end of the tool 11. The tool 11 includes a bushing 21. The bushing 21 is typically accommodated in a slidable manner in the lower portion 20. A guide is formed by a slide bearing between an inner wall of the blind hole 27 (e.g., the portion of the blind hole 27 in the lower portion 20) and a circumferential face of the bushing 21. In the bushing 21, a sleeve 22 is received and accommodated. The sleeve 22 accommodates the ball accommodation apparatus 12 such that the ball accommodation apparatus 12 is fixed in the sleeve 22. The sleeve 22 is detachable (e.g., replaceable) using a securement element 23 (e.g., a fastener). Thus, the ball accommodation apparatus 12 is accommodated in the tool 11 in a slidable manner and can move towards and away from the end 13 facing the workpiece 10.

Furthermore, a lower portion of a bolt 24 is accommodated in the bushing 21. The bolt 24 includes a circumferential ring portion 25 with an adjacent lower portion and with an adjacent upper portion. The diameter of the ring portion 25 is greater than the diameter of the lower portion and the diameter of the upper portion of the bolt 24. The upper portion of the bolt 24 is surrounded by biasing member 26 in the form of a coil spring having a first end arranged on the ring portion 25. A second end of the biasing member 26 is arranged on the upper end of the blind hole 27. In some embodiments, other biasing members, such as pneumatic cylinders or mechanical springs formed in another manner, are used.

The bushing 21 includes an opening 28 having a defined length and a defined axial position at which a stop screw 29 engages the bushing 21 along its longitudinal direction. As a result of the length and the position of the opening 28 together with the stop screw 29, the stroke about which the bushing 21 and, therefore, also, the sleeve 22 and the ball accommodation apparatus 12 may axially move is determined.

By the biasing member 26 (e.g., a coil spring), a biasing force is applied to the bushing 21 and, therefore, to the ball accommodating apparatus 12 via the bolts 24 and the bushing 22. The biasing force is applied to the lower portion 20 of the tool 11 via the opening 28 and the stop screw 29. In its rest position (shown in FIG. 4), the ball accommodation apparatus 12 is located in the tool 11 in a lower position and is biased towards the direction of the end 13.

In some embodiments, the tool 11 can include a device that enables adjustment of the biasing force on the ball accommodation apparatus 12. The device for adjusting the biasing force or an alternative suitable device of the tool 11 may be formed such that a constant pre-determinably adjustable biasing force can be provided independently from the stroke through which the ball accommodating apparatus 12 moves into the tool 11. That is, the biasing force can be generally constant while the ball accommodating apparatus 12 moves within the tool 11. Such a device can be, for example, a hydraulic or pneumatic cylinder, where the fluid used to drive the cylinder is controlled such that a constant pressure of the fluid is maintained independently from the stroke of the ball accommodating apparatus 12 into the tool 11.

Alternatively, an adjustment of the stroke of the plunger 6 (i.e., the distance between the upper tool holder 8 and the workpiece 10) and the resulting force is possible. For the adjustment, the plunger 6 can be moved away from the workpiece 10 when the force on the ball accommodation apparatus 12 becomes too large and the plunger 6 can be moved towards the workpiece 10 when the force on the ball accommodation apparatus 12 becomes too small until the force on the ball accommodation apparatus 12 is within a desired force range. Using such an adjustment of force on the ball accommodation 12, a separate biasing member 26 can be used. However, the use of a separate biasing member is typically not necessary. The force on the ball accommodation apparatus 12 can be detected in the tool 11 or, alternatively, in the punching machine 1 and, then, the plunger 6 can be controlled by the control device of the punching machine 1 and the plunger controller 7 such that the force on the ball accommodation 12 is maintained within a desired force range.

In use, the tool 11 accommodated in the upper tool holder 8 is moved downwards in the Z-direction until the ball 16 penetrates the foil 18 (shown in FIG. 3). This position in the Z-direction is then maintained. Then, the workpiece 10 with the foil 18 is moved such that by the rolling of the ball 16 along the workpiece 10, the foil 18 on the workpiece 10 is cut along the path of the ball 16. As a result, arbitrary paths and paths with small radii are possible. By completing a closed path or by completing a path that reaches the edges of the workpiece and/or orifices in the workpiece, a separated area of the foil is formed that may be removed in order to perform machining of the workpiece 10. On the side of the workpiece 10 opposite the tool 11, an even die plate or a die plate having a ball roll is used as a counter holder.

By the optionally slidable accommodation of the ball accommodation apparatus 12 in the tool 11, the machining conditions of the tool 11 are typically improved. When rolling over unevenness in the workpiece 10 or differences in the thickness of the workpiece 10, the ball 16 may move upward against the biasing force to reduce a risk of damaging the workpiece 10. When rolling over the unevenness in the workpiece 10 or over the differences in the thickness of the workpiece 10, the biasing force is slightly increased. However, in some cases, the acceptable force range to penetrate the foil without damaging the workpiece 10 can be small and therefore, even small increases in the biasing force may cause scratches or imprints on the workpiece 10.

By the making the biasing force further adjustable, the force with which the ball 16 penetrates the foil 18 may be adjusted (e.g., optimized) to help ensure that the foil is cut, but the surface of the workpiece 10 is not damaged.

In order to avoid such damage, alternatively, an adjustment of the distance between the upper tool holder 8 and the workpiece 10 can be performed. The distance can be adjusted such that a consistent force (e.g., a substantially constant force) between the ball 16 and the workpiece 10 is provided. The adjustment of the distance between the upper tool holder 8 and the workpiece 10 can alternatively be performed by controlling the plunger 6, the control device of the punching machine 1, or a particular device in the tool 11.

The tool 11 does not necessarily need to be accommodated in the upper tool holder 8 of a punching machine 1. Alternatively, an accommodation in the lower tool holder 9 is possible in order to cut a foil on a lower side of the workpiece 10.

Additionally, the tool 11 can be alternatively accommodated in a holder that is not one of the tool holders 8, 9 for punching tools but is a separate tool holder provided for the tool 11. This separate tool holder may also be provided in another type of sheet metal working machine (e.g., a laser processing machine). Furthermore, it is not required that the tool 11 be moved towards the workpiece 10. Instead, it is possible to move the workpiece 10 towards the tool 11. Also, it is not required that the workpiece 10 moves for cutting the foil. Rather, the tool 11 may be accommodated such that it moves with respect to a fixed workpiece 10.

In embodiments of the tool 11 having the cavity 17 for receiving a fluid, as an alternative application to cutting the foil with a ball, it is possible to fill the cavity 17 with a fluid (e.g., a corrosive agent) having a corrosive effect. Thus, the corrosive agent can be applied, for example, on metallic foils using the ball 16, where the application of the corrosive agent is a substitution for shearing the contours in metallic foils. Moreover, the corrosive agent can also be applied on the surface of the workpiece 10 and appropriate surface structures may be etched using the tool 11.

A number of embodiments of the invention have been described. Nevertheless, it will be understood that various modifications may be made without departing from the spirit and scope of the invention. Accordingly, other embodiments are within the scope of the following claims.

What is claimed is:

1. A tool for a sheet metal processing machine for cutting a foil disposed on a planar surface of a workpiece to be processed, the tool comprising:

a rotatably supported ball at a first end of the tool for cutting the foil by rolling the ball along the workpiece, wherein the tool is configured to cut the foil along arbitrary paths including nonlinear paths by a rolling cutting movement of the rotatably supported ball over the surface of the workpiece; and a biasing member at a second end of the tool opposite the first end and configured to cause the rotatably supported ball to completely penetrate the foil so that the ball contacts the planar surface of the workpiece after penetrating the foil.

2. The tool according to claim 1, further comprising a ball accommodation apparatus having an accommodation chamber formed at an end of the ball accommodation apparatus facing the workpiece, the accommodation chamber comprising an orifice at the end of the ball accommodation apparatus, the accommodation chamber being formed to accommodate the ball so that the ball protrudes from the orifice and out of the ball accommodation apparatus, and the ball is substantially only rotatable within the ball accommodation apparatus.

3. The tool according to claim 2, wherein the ball accommodation apparatus comprises a cavity for accommodating a lubricant for reducing a coefficient of friction between a surface of the ball and an inner surface of the accommodation chamber, wherein the cavity is fluidly connected to the accommodation chamber.

4. The tool according to claim 1, wherein the ball comprises a material that is harder than a material of the workpiece.

5. The tool according to claim 4, wherein the ball comprises a ceramic material.

6. The tool according to claim 1, wherein the ball has a diameter that is less than about 1 mm.

7. The tool according to claim 1, wherein the tool is configured to be received in a punching tool holder of a punching machine.

8. A system comprising:

a sheet metal processing machine; and a tool for cutting a foil disposed on a workpiece to be processed by the sheet metal processing machine, the tool comprising:

a rotatably supported ball for cutting the foil by rolling the ball along the workpiece, wherein the tool is configured to cut the foil along arbitrary paths by a rolling cutting movement of the rotatably supported ball over the surface of the workpiece, and wherein the sheet metal processing machine comprises a tool holder for accommodating the tool and a workpiece support device for positioning the workpiece, and the sheet metal processing machine is configured such that the tool holder or the workpiece support device is vertically movable such that a determinable distance between the tool holder and a surface of the workpiece is produced so that the ball penetrates the foil and the determinable distance can be maintained while the sheet metal is moved horizontally with respect to the tool holder in order to cut the foil.

9. The system according to claim 8, wherein the sheet metal processing machine is a punching machine comprising a workpiece movement device and the punching machine is configured such that the determinable distance is maintained while the sheet metal is moved along a plane by the workpiece movement device.

10. The system according to claim 8, wherein the sheet metal processing machine is a laser processing machine.

11. A tool for a sheet metal processing machine for cutting a foil disposed on a surface of a workpiece to be processed, the tool comprising:

a rotatably supported ball for cutting the foil by rolling the ball along the workpiece, wherein the tool is configured to cut the foil along arbitrary paths including nonlinear paths by a rolling cutting movement of the rotatably supported ball over the surface of the workpiece, a ball accommodation apparatus having an accommodation chamber formed at an end of the ball accommodation apparatus facing the workpiece, the accommodation chamber comprising an orifice at the end of the ball accommodation apparatus, the accommodation chamber being formed to accommodate the ball so that the ball protrudes from the orifice and out of the ball accommodation apparatus, and the ball is substantially only rotatable within the ball accommodation apparatus, and a biasing member by which the ball accommodation apparatus is forced in the direction towards the end, wherein the ball accommodation apparatus is accommodated in the tool in a slidable manner and is movable in a direction that is towards and away from the end.

12. The tool according to claim 11, further comprising a biasing force adjusting device configured to adjust the biasing force of the biasing member in the direction towards the end.

13. The tool according to claim 11, wherein the biasing member is configured to maintain a substantially constant biasing force in the direction towards the end independently of a displacement of the ball accommodation apparatus within the tool.

14. The tool according to claim 11, wherein the ball accommodation apparatus comprises a cavity for accommodating a lubricant for reducing a coefficient of friction between a surface of the ball and an inner surface of the accommodation chamber, wherein the cavity is fluidly connected to the accommodation chamber.

15. The tool according to claim 11, wherein the ball comprises a material that is harder than a material of the workpiece.

16. The tool according to claim 15, wherein the ball comprises a ceramic material.

17. The tool according to claim 11, wherein the ball has a diameter that is less than about 1 mm.

18. The tool according to claim 11, wherein the tool is configured to be received in a punching tool holder of a punching machine.

* * * * *